United States Patent [19]

Kanzaka

[11] 4,407,049

[45] Oct. 4, 1983

[54] BUCKLE FOR BELTS OR THE LIKE

[75] Inventor: Yoshihiro Kanzaka, Nyuzen, Japan

[73] Assignee: Yoshida Kogyo, K.K., Tokyo, Japan

[21] Appl. No.: 277,642

[22] Filed: Jun. 26, 1981

[30] Foreign Application Priority Data

Jul. 18, 1980 [JP] Japan ..... 55-101539[U]

[51] Int. Cl.[3] ..... A44B 19/00

[52] U.S. Cl. ..... 24/230 AS

[58] Field of Search ..... 24/230 AS, 214, 230 R

[56] References Cited

U.S. PATENT DOCUMENTS

| | | | |
|---|---|---|---|
| 3,200,464 | 8/1965 | Cousins | 24/230 |
| 3,798,711 | 3/1974 | Cousins | 24/230 R |
| 4,060,879 | 12/1977 | Takada | 24/230 A |
| 4,282,634 | 8/1981 | Krauss | 24/230 R |

FOREIGN PATENT DOCUMENTS

| | | | |
|---|---|---|---|
| 1328405 | 4/1963 | France | 24/230 AL |

*Primary Examiner*—Gene Mancene
*Assistant Examiner*—Wenceslao J. Contreras
*Attorney, Agent, or Firm*—Robert E. Burns; Emmanuel J. Lobato; Bruce L. Adams

[57] ABSTRACT

A buckle device comprising a plug member and a receptacle member, each of said members having a means of retaining a loose end of a belt or the like. The receptacle member has one of its ends open for receiving the plug member. Projecting lugs integral with the receptacle member are provided on opposite sides thereof, leaving a gap therebetween for unobstructed movement of the fingers of the user.

7 Claims, 9 Drawing Figures

BUCKLE FOR BELTS OR THE LIKE

BACKGROUND OF THE INVENTION

1. Field of the Invention

This invention relates to a buckle for fastening loose ends of a belt or strap.

2. Prior Art

There have been proposed many forms of buckle designed to releasably connect loose ends of a belt, strap and the like. A typical example of such known buckle, as described for example in U.S. Pat. No. 3,200,464, patented Aug. 17, 1965, comprises a male or plug member and a female or receptacle member, the male member having a locking projection to be resiliently inserted into an opening in the female member, whereby the two members can be snapped into and out of engagement with each other. However, when releasing the male member from the female member, it has been necessary to manipulate the buckle with both hands because of the presence of an upper plate portion at the entrance end of the female member which would necessitate pushing the male member underneath the plate portion with one hand while pulling it out past the same portion with the other hand.

SUMMARY OF THE INVENTION

According to the invention, there is provided a buckle for fastening together loose ends of a belt or the like, comprising a male part and a female part, the parts each having a belt-end retainer connected to one of the ends of the belt. The male part comprises a plug member and the female part comprises a receptacle member engageable with the plug member. The plug member has opposite flat side portions and a raised head portion defining therebetween a generally U-shaped groove to permit the raised head portion to flex resiliently, the head portion including a pair of sloped shoulders which are inclined progressively upwardly and a button portion lying in a plane parallel to the flat side portions. THe receptacle member has a transverse closed rear-end flange portion, opposite side flange portions integral therewith and a guide channel formed coextensively with the flange portions, the side flange portions having at their respective free ends a pair of inwardly projecting lugs which confront with each other across a gap at the front end of the receptacle member. The lugs engage the shoulders of the head portion when the male and female parts are coupled.

It is an object of the present invention to provide an improved buckle which is simple in construction and efficient in performance.

A more specific object of the invention is to provide an improved buckle which can be manipulated by a single-hand touch with a maximum of ease.

These objects and other features of the invention will be better understood from the following detailed description taken in conjunction with the accompanying drawings which illustrate by way of example a preferred embodiment which the invention may assume in practice.

DETAILED DESCRIPTION OF THE PREFERRED EMBODIMENT

Figure 1:
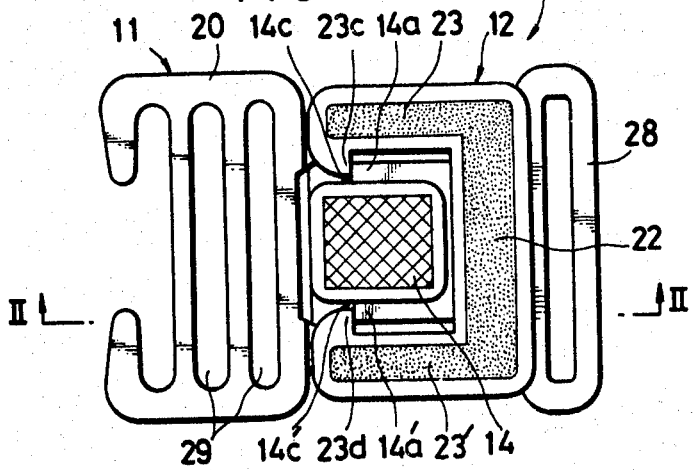
FIG. 1 is a plan view showing the construction of a buckle embodying the invention.
Figure 2:
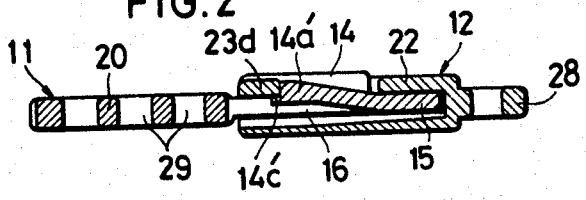
FIG. 2 is a cross-sectional view taken on the line II—II of FIG. 1.
Figure 3:
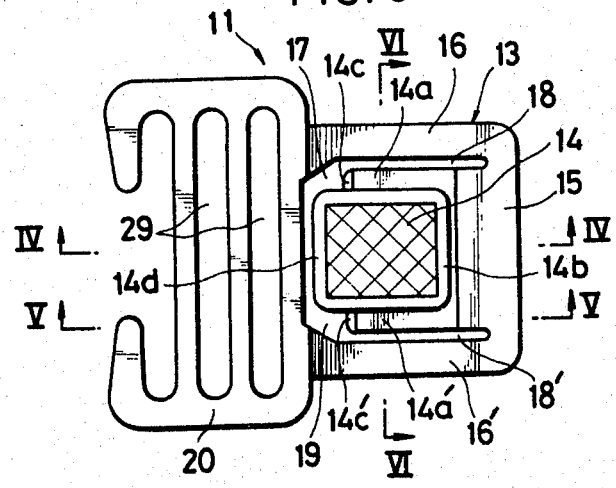
FIG. 3 is a plan view of a male part of the buckle of FIG. 1.
Figure 4:
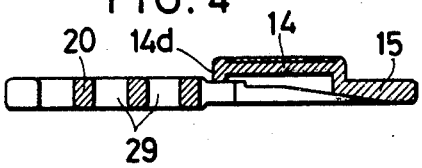
FIG. 4 is a cross-sectional view taken on the line IV—IV of FIG. 3.
Figure 5:
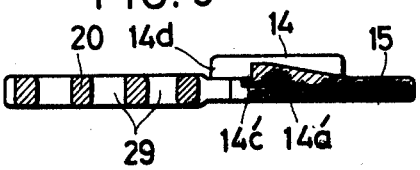
FIG. 5 is a cross-sectional view taken on the line V—V of FIG. 3.
Figure 6:
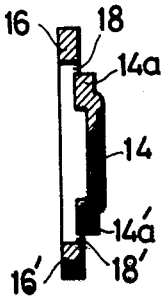
FIG. 6 is a cross-sectional view taken on the line VI—VI of FIG. 3.

Referring to the drawings and FIG. 1 in particular, there is shown a buckle 10 embodying the invention and which generally comprises a male or plug part 11 and a female or receptacle part 12, the two parts being releasably coupled.

The male part 11 of the buckle 10, as better shown in FIGS. 3 through 6 inclusive, comprises a generally rectangular plate-like plug member 13 having a centrally raised head portion 14. The plug member 13 has a front end portion 15 and opposite flat side portions 16,16' which define with the raised portion 14 a generally U-shaped cut-out groove 17 having relatively narrow parallel branches 18,18' merging into a relatively wide bay 19. The provision of this cutout groove 17 permits the raised head portion 14 to flex resiliently in a manner similar to a leaf spring. The head portion 14 includes a pair of sloped shoulders **14*a*,14*a'* which are inclined progressively upwardly toward the bay 19 and a substantially square button portion 14*b* with its top surface normally lying in a plane parallel to the plug portions 15, and 16,16'. The raised head portion 14 serves to lock the male part 11 with, and release the same from, the female part 12 in a manner hereinafter to be described, for which purpose the shoulders 14*a*,14*a'* are provided with substantially L-shaped recesses 14*c*,14*c'* confronting with the bay 19. The button portion 14*b* projects at its one end 14*d* beyond the recesses 14*c*,14*c'* into the bay 19**.

The male part 11 is provided with a belt-end retainer 20 integrally formed with the plug member 13 and having transverse openings 29 for receiving one end of a belt-like article not shown.

Figure 9:
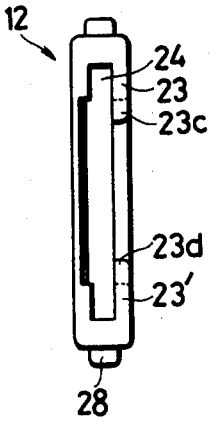
FIG. 9 is a left-hand side elevation of FIG. 7.
Figure 7:
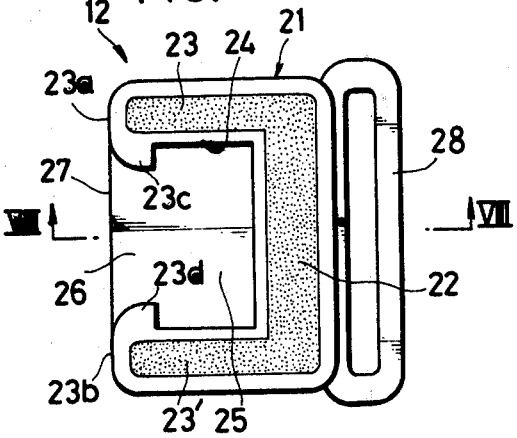
FIG. 7 is a plan view of a female part of the buckle.
Figure 8:
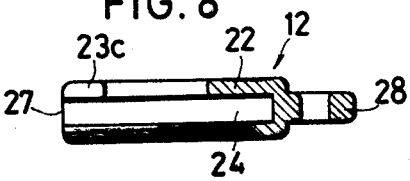
FIG. 8 is a cross-sectional view taken on the line VIII—VIII of FIG. 7.

FIGS. 7 through 9 inclusive are provided to illustrate the construction of the female part 12 of the buckle 10. The female part 12 comprises a generally rectangular receptacle member 21 having a transverse closed rear-end flange portion 22 and opposite side flange portions 23,23' integral therewith. A guide channel 24 is formed coextensively with the flange portions 22 and 23,23' and communicates with a substantially square center opening 25. At the free ends **23*a*,23*b* of the respective side flange portions 23,23', there are provided a pair of inwardly projecting lugs 23*c* and 23*d* which confront with each other across a gap 26 at the open front end 27 of the receptacle member 21. During use, the projected end 14*d* of the button portion 14*b* is inserted in the gap 26 once when the male part 11 and the female part 12** are coupled together in such a manner described hereinbelow.

Designated at 28 is a belt-end retainer for retaining thereat the other end of the belt-like article.

When coupling the male part 11 with the female part 12 as shown in FIG. 1, the button portion **14*b* may be conveniently held in the hand of the user and manipulated so as to insert the plug member 13 into the receptacle member 21, in which instance the side plug portions 16,16' are introduced into the guide channel 24 defined by the side flange portions 23,23' respectively until the front end portion 15 of the plug member 12 comes in registry with the closed-end flange portion 22 of the receptacle member 21. During this coupling movement of the plug member 13, the raised head portion 14 is flexed downwardly from its rest position in contact with the lugs 23c,23d of the receptacle member 21. When the plug member 13 has been thus fully inserted into the receptacle member 21, the button 14b, is released and flexes back to its rest position, whereupon the lugs 23c,23d of the receptacle 21 are held in abutting engagement with the recesses 14c,14c' of the plug 13 thereby locking the buckle 10** in place.

When removing the plug 13 from the receptacle 21, the button 14b is depressed to its flexed position to disengage the lugs 23c,23d from the recesses 14c,14c' respectively and thereafter the plug 13 is drawn out of the receptacle 21. All of this manipulation can be done simply with one hand, as there is no obstacle at the gap 26 of the receptacle 21 which would have been otherwise occupied in the case of the conventional counterparts by an upper front plate portion corresponding to that of the closed rear-end flange 22.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle for fastening together loose ends of a belt or the like, the buckle comprising: a male part and a female part, said parts each having a belt-end retainer connected to one of the ends of the belt, said male part comprising a plug member and said female part comprising a receptacle member releasably engageable with said plug member; said plug member having opposite flat side portions and a raised head portion defining therebetween a generally U-shaped groove to permit said raised head portion to flex resiliently, said head portion including a pair of sloped shoulders which are inclined progressively upwardly and a button portion lying in a plane parallel to said flat side portions; said receptacle member having a transverse closed rear-end flange portion, two oppositely disposed side flange portions having their respective one ends integrally connected to opposite ends of the rear-end flange portion and having their respective other ends free, and a guide channel formed coextensively with said flange portions, said side flange portions having at their respective free ends a pair of inwardly projecting lugs which project inwardly towards one another and which are spaced apart by a gap at the front end of said receptacle member, said lugs being configured to releasably engage with said shoulders of said head portion upon insertion of said plug member into said receptacle member to thereby releasably couple together said male and female parts.

2. A buckle as claimed in claim 1, wherein said shoulders of said plug member include substantially L-shaped recesses for receiving said lugs of said receptacle member when the two parts are coupled.

3. A buckle as claimed in claim 2, wherein said button portion projects at its one end beyond said recesses into said gap, said gap receiving therein said one end of said button portion when said two parts are coupled.

4. A buckle for fastening together opposite ends of a belt or the like comprising: a receptacle member attachable to one end of the belt; and a plug member attachable to the other end of the belt and releasably engageable with the receptacle member; the plug member comprising a pair of spaced-apart side portions, a front portion connected at opposite ends to respective ones of the side portions, and a raised head portion connected to the front portion and extending rearwardly between the pair of side portions in spaced relation thereto so as to enable the raised head portion to be manually resiliently flexed relative to the front and side portions from a rest position in which the raised head portion is elevated with respect to the front and side portions to a flexed position in which the raised head portion is flexed downwardly toward the front and side portions; the receptacle member comprising a pair of spaced-apart side channel portions, and a rear channel portion connected at opposite ends to respective ones of the side channel portions to define therewith a guide channel configured to receive therein the side and front portions of the plug member; and coupling means for releasably coupling the plug member to the receptacle member upon insertion of the plug member into the receptacle member, the coupling member comprising a pair of inwardly extending projections on the receptacle member connected to respective ones of the side channel portions at the front ends thereof remote from the rear channel portion, the projections extending inwardly towards one another and being spaced apart a distance sufficient to enable the raised head portion of the plug member to pass therebetween during insertion of the plug member into the receptacle member, and a pair of shoulders on the plug member connected to opposite sides of the raised head portion and positioned to releasably engage with respective ones of the projections when the raised head portion is in its rest position to thereby releasably couple the inserted plug member to the receptacle member; whereby manual flexing of the raised head portion downwardly to its flexed position effects disengagement of the shoulders from the projections to enable withdrawal of the plug member from the receptacle member.

5. A buckle according to claim 4; wherein the side and front portions of the plug member are generally flat and coplanar, and the raised head portion having a generally flat button portion lying in a plane parallel to and elevated with respect to the plane of the side and front portions when the raised head portion is in its rest position.

6. A buckle according to claim 4; wherein the pair of shoulders of the plug member have sloping portions which slope progressively upwardly in the rearward direction from the front portion, the sloping portions slidably engaging with the projections of the receptacle member to effect resilient flexing of the raised head portion downwardly toward its flexed position during insertion of the plug member into the receptacle member.

7. A buckle according to claim 6; wherein the shoulders of the plug member comprise substantially L-shaped recessed portions disposed at the ends of the sloping portions and configured to permit upward flexing of the raised head portion to releasably engage the recessed portions with the projections when the plug member has been fully inserted into the receptacle member.

* * * * *